US010485725B2

(12) United States Patent
Brockway et al.

(10) Patent No.: US 10,485,725 B2
(45) Date of Patent: Nov. 26, 2019

(54) ROLLATOR WITH STAND ASSEMBLY

(71) Applicant: MEDLINE INDUSTRIES, INC., Northfield, IL (US)

(72) Inventors: Todd Brockway, Vernon Hills, IL (US); Emily Berman, Park Ridge, IL (US); Caren Wax, Deerfield, IL (US); Tambra Martin, Trevor, WI (US); William Elliott Brooks, Chicago, IL (US); Robert W. Sheldon, Winnetka, IL (US); Gregory J. Foster, Chicago, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 16/046,659

(22) Filed: Jul. 26, 2018

(65) Prior Publication Data

US 2019/0029915 A1 Jan. 31, 2019

Related U.S. Application Data

(60) Provisional application No. 62/537,824, filed on Jul. 27, 2017.

(51) Int. Cl.
*A61H 3/04* (2006.01)
*A61H 1/00* (2006.01)

(52) U.S. Cl.
CPC ..... *A61H 3/04* (2013.01); *A61H 1/00* (2013.01); *A61H 2003/046* (2013.01); *A61H 2201/0161* (2013.01)

(58) Field of Classification Search
CPC ..... A61G 5/14; A61G 5/085; A61G 5/128; A61G 5/1059; A61G 5/02
See application file for complete search history.

(56) References Cited

U.S. PATENT DOCUMENTS 3,616,541 A * 11/1971 Crayton ..... G01B 3/12 33/781
4,700,730 A * 10/1987 Samuelson ..... A61H 3/04 135/67
5,636,651 A * 6/1997 Einbinder ..... A61H 3/04 135/65
6,412,805 B1 * 7/2002 Chen ..... B62H 1/04 280/302
D499,033 S * 11/2004 Stevermer ..... G01B 3/12 D10/70

(Continued)

*Primary Examiner* — Erez Gurari
(74) *Attorney, Agent, or Firm* — Fitch, Even, Tabin & Flannery LLP

(57) ABSTRACT

Disclosed is a rollator that comprises a supporting frame with a user gripping portion and plural rolling wheels, the frame being foldable over a range of travel between a fully open operating position and a fully closed storage position, and a stand assembly connected to an element of the frame and configured to support the rollator when the rollator is in the fully closed storage position. The stand assembly comprises a stand and a bracket, the stand being pivotable with respect to the bracket and movable over a range of travel between a stowed position and a support position. The stand is equipped with a cam mechanism that includes a cam surface and a sprung follower that engages the cam surface for indexing of the stand in the stowed position or the support position.

15 Claims, 8 Drawing Sheets

(56) References Cited

U.S. PATENT DOCUMENTS

| | | | | |
|---|---|---|---|---|
| 6,892,470 | B2 * | 5/2005 | Olson | G01B 3/12 33/781 |
| 7,040,036 | B1 * | 5/2006 | Wang | G01B 3/12 33/772 |
| D681,642 | S | 5/2013 | Meadows | |
| D721,013 | S | 1/2015 | Fragassi | |
| D728,580 | S | 5/2015 | Campbell | |
| D777,606 | S | 1/2017 | Dai | |
| D803,222 | S | 11/2017 | Cheng | |
| D829,722 | S | 10/2018 | Kim | |
| 2007/0084076 | A1 * | 4/2007 | Wang | G01B 3/12 33/772 |
| 2015/0290055 | A1 * | 10/2015 | Nicholas | A61G 5/10 280/10 |
| 2017/0055660 | A1 | 3/2017 | Tien | |

* cited by examiner

ROLLATOR WITH STAND ASSEMBLY

This application claims the benefit of U.S. Provisional Application No. 62/537,824, filed Jul. 27, 2017, for ROLLATOR WITH STAND ASSEMBLY, which is incorporated in its entirety herein by reference.

BACKGROUND

Rollators are commonly used by the elderly and by others with limited physical mobility. Conventional rollators comprise a frame connected to a plurality of wheels, typically four wheels and an operator gripping surface, typically a pair of handles. Conventionally, the rollator may be folded between an operating configuration and a storage configuration.

Now, a stand assembly for a rollator has been devised. The stand assembly includes a stand and a bracket, the bracket being connectable to the frame, typically at a tubular frame element. The stand assembly is configured to support the rollator when the rollator is in the fully closed storage position. The stand assembly included a stand that is pivotable with respect to the bracket and that is movable over a range of travel between a stowed position and a support position. When in the stowed position, the stand is out of the way of the user and does not inhibit contact between the wheels of the rollator and the ground or flooring surface. When in the support position, a base of the stand contacts the ground or floor and, in conjunction with at least one of the rollator wheels, provides support for the rollator. This arrangement provides numerous advantages in that the rollator will be free-standing on a level surface.

The stand assembly is described with reference to use on a rollator, but it is contemplated that the stand assembly also may be used on wheeled or unwheeled walkers.

DETAILED DESCRIPTION

Figure 1:
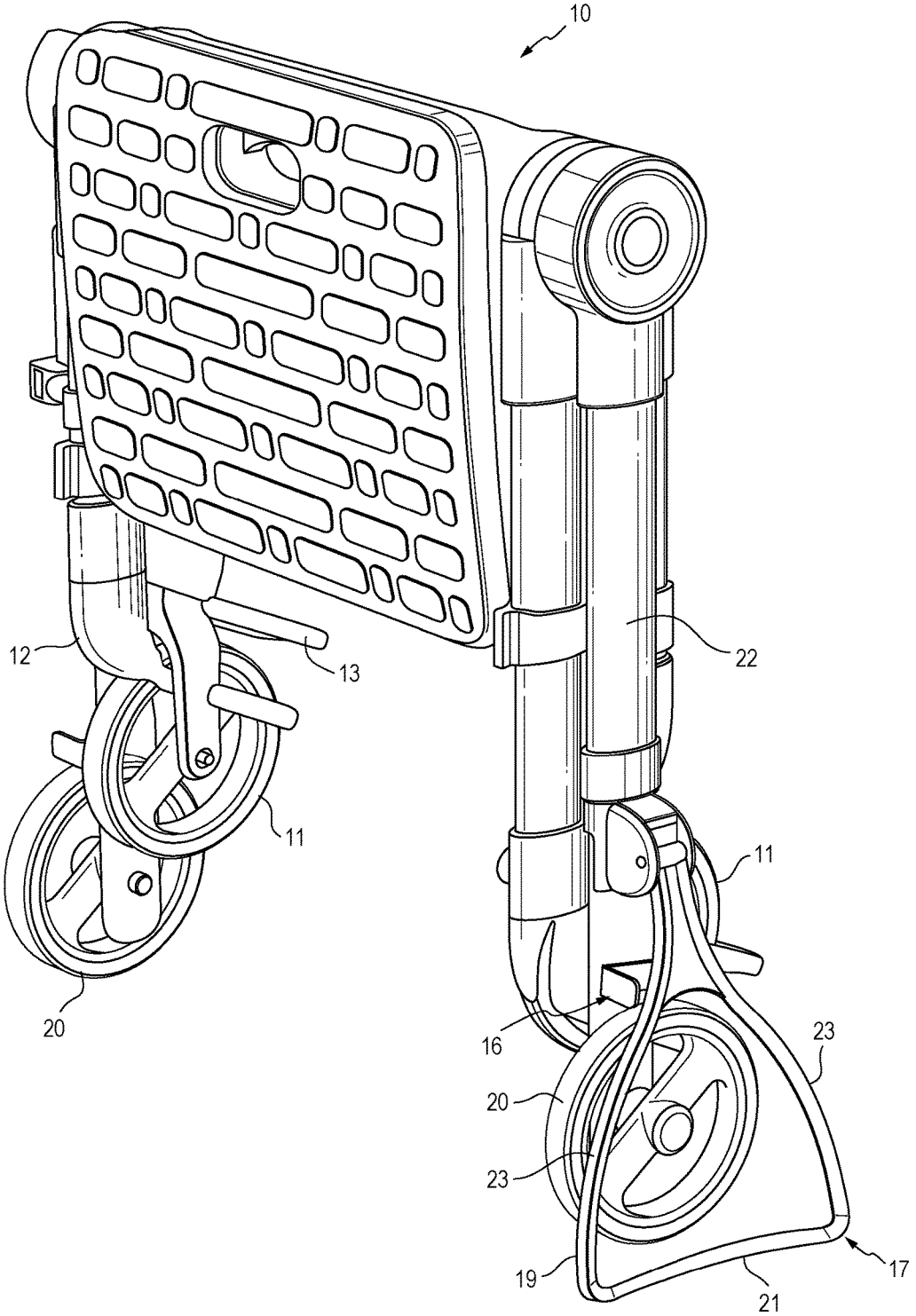
FIG. 1 is a perspective view of a rollator according to one embodiment, illustrating the stand in the support position.
Figure 2:
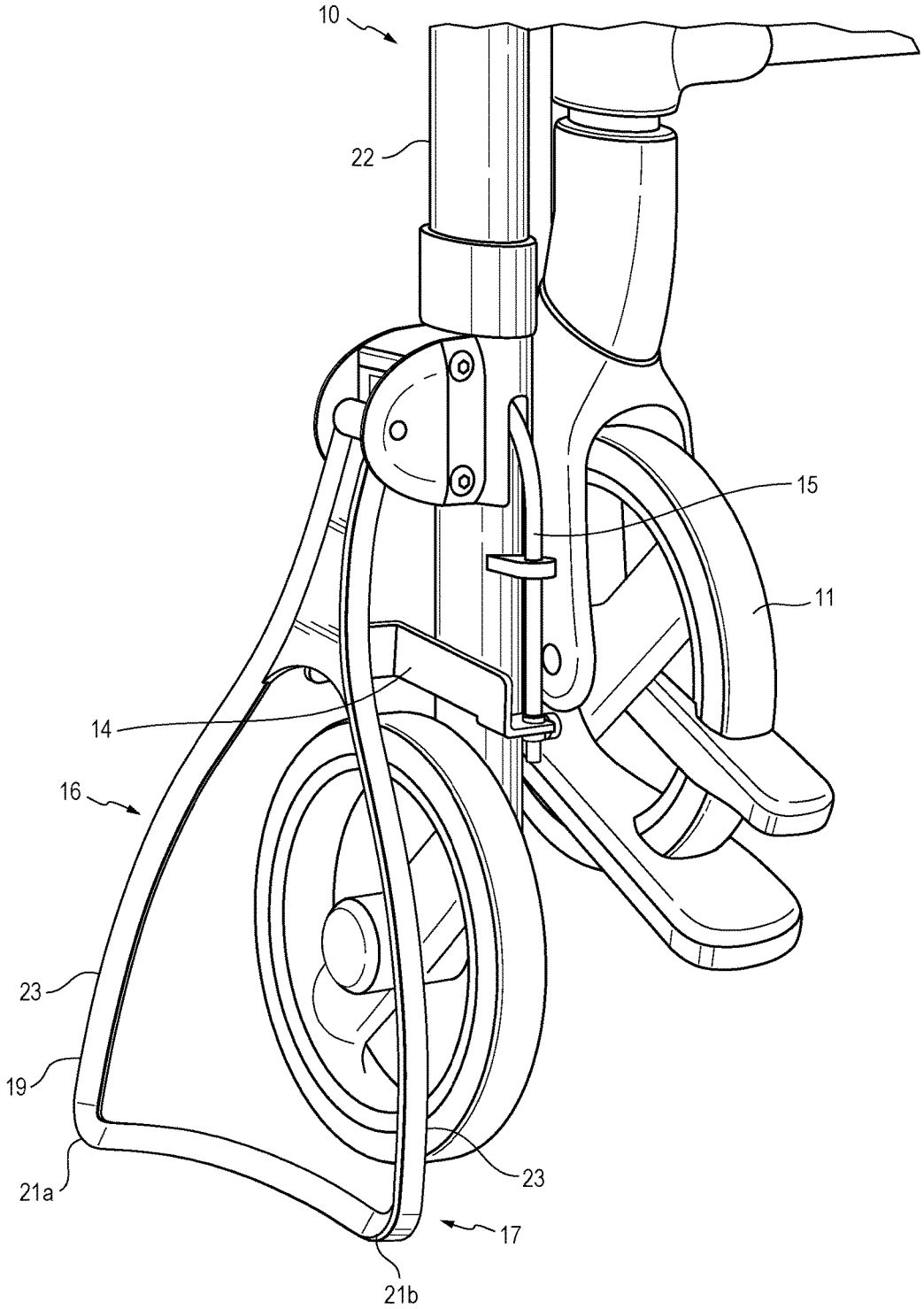
FIG. 2 is a relatively enlarged perspective view of a lower region of the rollator depicted in FIG. 1.
Figure 3:
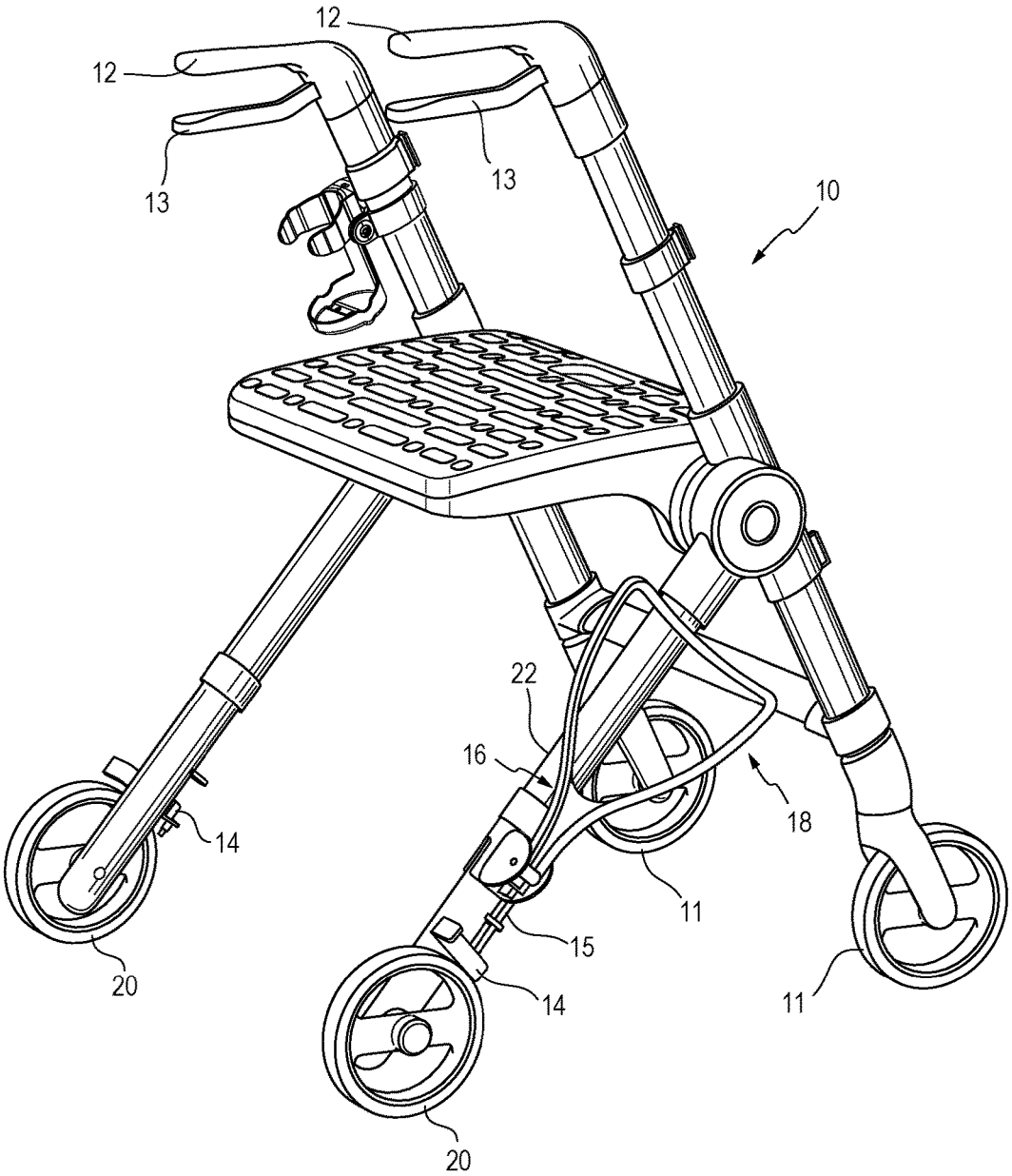
FIG. 3 is a perspective view of the rollator illustrated in FIG. 1, illustrating the frame of the rollator in a fully open operating position and illustrating the stand in a stowed position.

With reference now to FIGS. 1-3, the rollator 10 comprises a supporting frame that is composed generally of a number of interconnected tubular members and other support structures. The rollator comprises two pairs of wheels 11, 20 and an operator gripping portion 12, which, in the illustrated embodiment, comprises a pair of handles. The rollator is equipped with brake handles 13 and a plurality of rear brakes 14 which are operated via brake cables (one shown as cable 15 in FIGS. 2 and 3).

The rollator 10 is provided with a stand assembly 16 that is movable between a support position 17, illustrated in FIGS. 1 and 2, and a stowed position 18, as illustrated in FIG. 3. The stand assembly is fixed axially along the tubular frame element 22 but may be adjusted to any desired axial position. Preferably, though, the stand assembly is axially positioned such that, when the stand is in the support position, the base 21 is laterally even with the rear wheels 20, as illustrated in FIGS. 1 and 2. Additionally, the rollator may be manually grasped and repositioned by rolling of the lower wheels 20 when in the support position without the need to adjust the stand. As illustrated, the stand 19 includes a base 21 that provides lateral support on either side of the tubular frame element 22, and is configured with a generally triangular region that has first and second support arms 23. As seen, the base has a slightly curved surface that has a lateral extension away from the frame element 22 in either direction when in this support position. At least the corner regions 21*a*, 21*b* of the base 21 and wheels 20 provide multi-point support for the rollator 10, thereby enabling independent support of the rollator 10 when the rollator is in the fully closed storage position. Optionally, the stand assembly may be positioned such that the stand, when in the support position, is slightly lower than the real wheels 20, such that the rear wheel that is proximal the stand is slightly elevated. In this configuration, support is provided by the opposing wheel.

Figure 4:
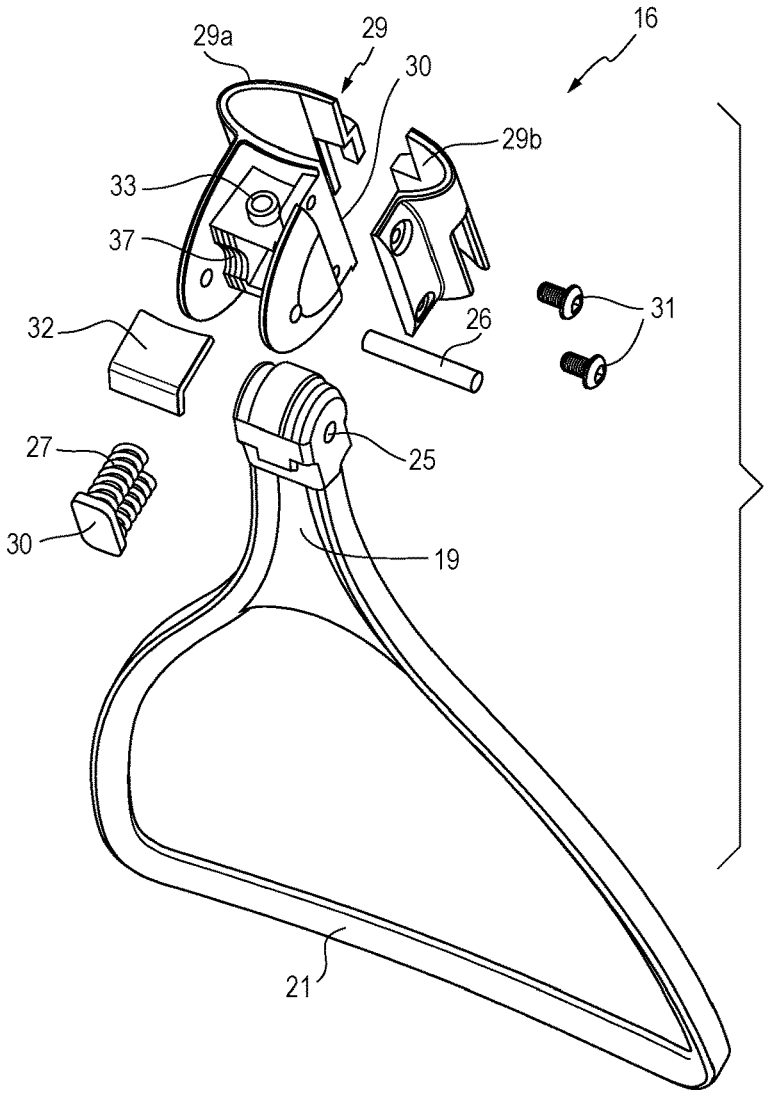
FIG. 4 is an exploded view of the stand assembly depicted in FIGS. 1-3.
Figure 5:
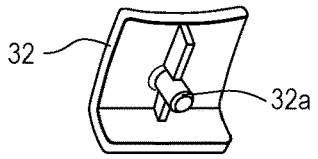
FIG. 5 is a bottom perspective view of the cover of the stand assembly.
Figure 6:
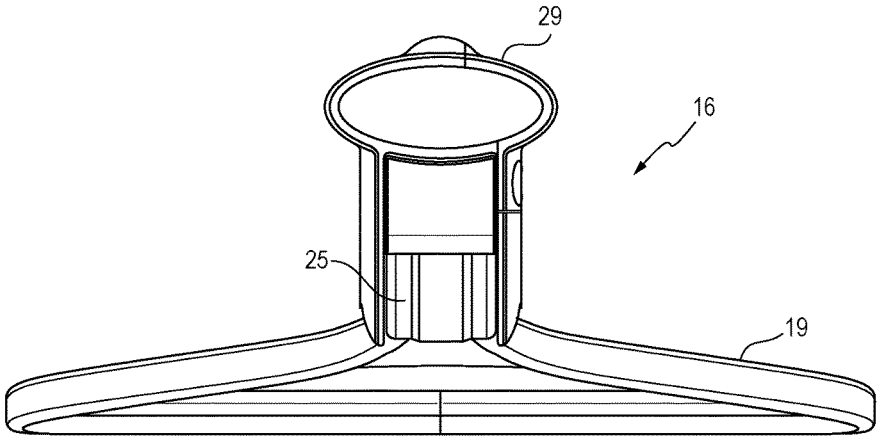
FIG. 6 is a top plan view illustrating the stand assembly with the stand in the support position.
Figure 7:
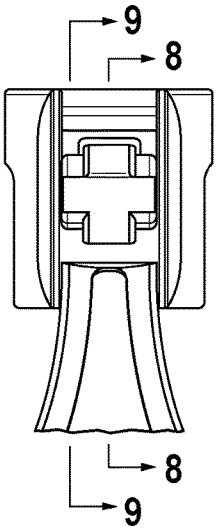
FIG. 7 is a front elevational view of a portion of the stand assembly illustrated in FIG. 6.

With reference to FIGS. 4 and 5, the stand 19 includes a cam surface 25, which will be discussed in more detail hereinbelow. The stand 19 is pivotable with respect to the bracket about pivot pin 26. A pair of springs 27 is seated in recess 28 of the bracket 29, the springs being connected to a follower surface 30. In this embodiment, the bracket 29 is provided in two parts 29*a*, 29*b* which are connected via screws 31 to provide a frictional fit around the tubular element 22 of the rollator 10, as seen for instance in FIG. 3. A cover 32 includes a pin 32*a* (FIG. 5) which is seated in socket 33 in the bracket portion 29*a*. The bracket 29 includes a slot 38 to accommodate brake cable 15.

Figure 8:
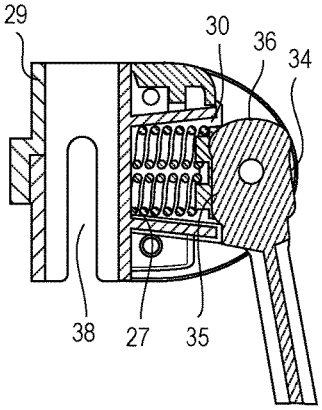
FIGS. 8 and 9 are sections taken along lines 8-8 and 9-9 in FIG. 6.
Figure 9:
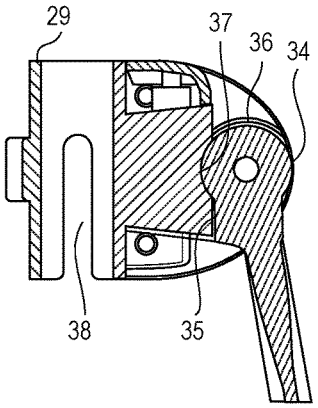
Figure 10:
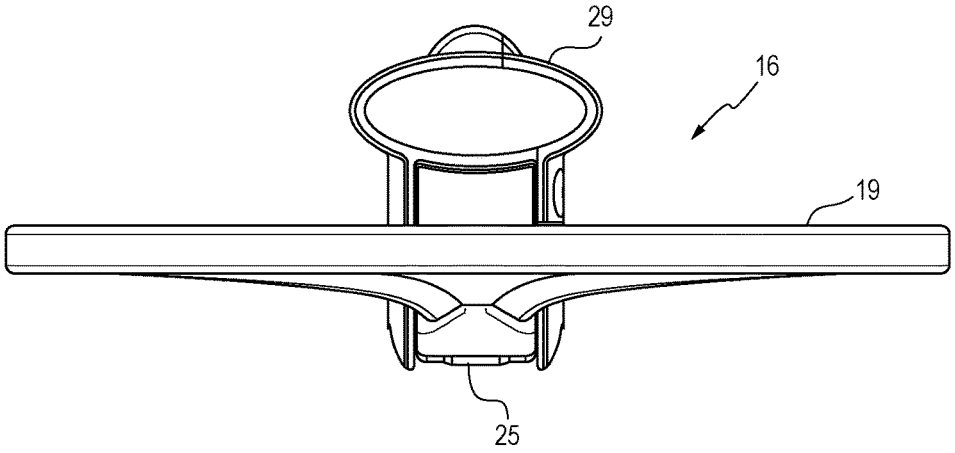
FIG. 10 is a top plan view illustrating the stand assembly with the stand in the stowed position.
Figure 11:
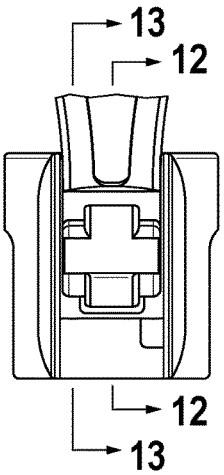
FIG. 11 is a front elevational view of a portion of the stand assembly illustrated in FIG. 6.
Figure 12:
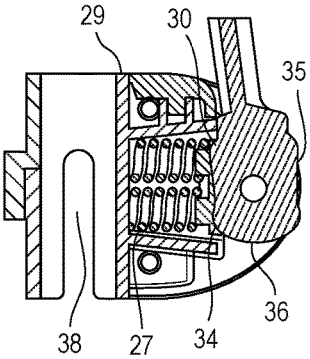
FIGS. 12 and 13 are sections taken along lines 12-12 and 13-13 in FIG. 11.
Figure 13:
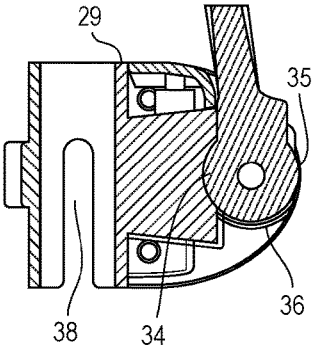

Operation of the stand can be envisioned with reference to FIGS. 6-13. With particular reference to FIG. 8, the cam surface is functionally integral with respect to the stand, and indeed the stand and cam surface may be molded as a single part. The cam surface 25 has a stowage region 34 and a supporting region 35 and an intermediate region 36 (FIG. 8). As seen in FIG. 9, the recess 28 in the bracket 29 includes a cutout 37 (seen also in FIG. 4) to accommodate the intermediate region 36 during pivotal movement of the stand relative to the bracket.

As seen in FIG. 8, springs 27 bias the follower 30 against the supporting region 35 of the cam surface 25 to thereby retain the stand in an indexed manner in the support position.

Conversely, when the stand is in the stowed position of FIGS. 10-13, springs 27 bias the follower 30 against the stowage region 34 thereby created a second indexed position for the stand 19. When the stand is rotated to intermediate positions (not shown) between the support position and stowed position shown in FIGS. 10-13, the intermediate region 36 of the cam surface 25 engages the follower surface 30. This causes the springs to become compressed further, thereby urging the stand towards either the support position of the stowed position. Via this arrangement, the stand is constructed to be indexable between the relatively more stable support and stowed positions. The stand is relatively less stable in the intermediate positions.

Figure 14:
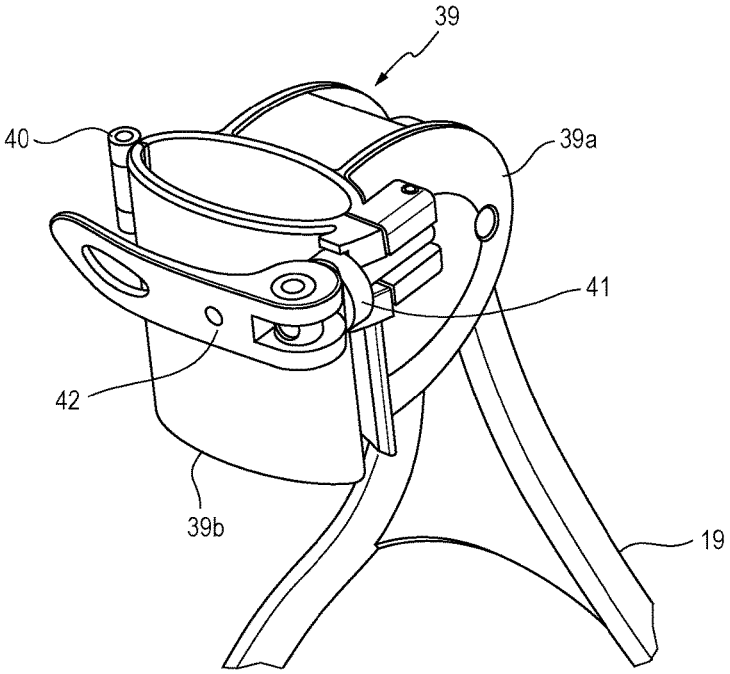
FIG. 14 is a perspective view of an alternative embodiment of the stand assembly, illustrating a quick-release mechanism and the bracket in a closed position.
Figure 15:
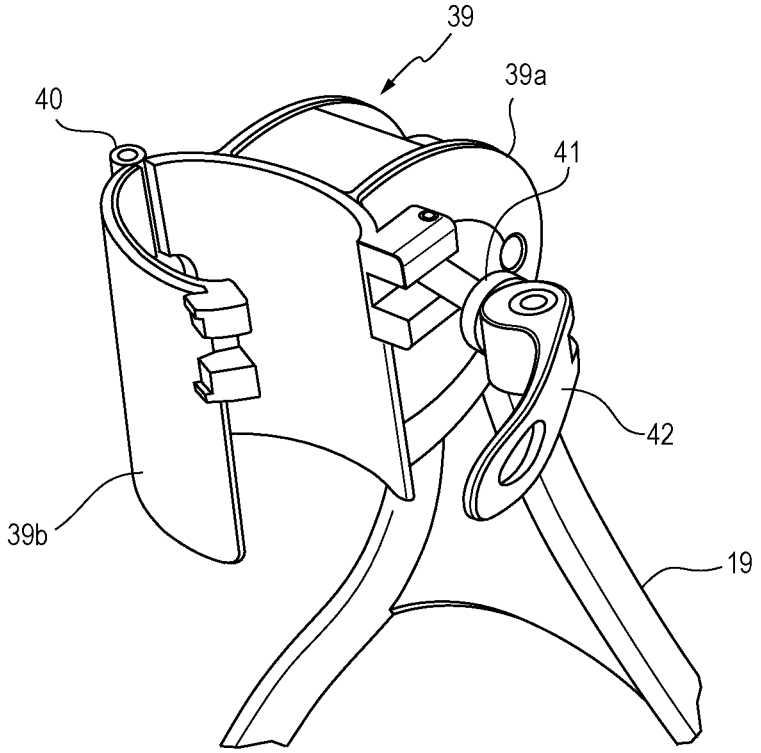
FIG. 15 is a perspective view of the stand assembly illustrated in FIG. 14, illustrating the quick-release assembly in a disengaged position and the bracket in an open position.

In lieu of the screws 31, the bracket may be equipped with a quick-release mechanism, as shown in FIGS. 14 and 15. In this embodiment, the bracket 39 has a hinge 40 and a quick-release lever 42 is pivotally mounted to a first bracket portion 39*a* of the bracket 39. A locking member 41 may be provided to ensure proper fitting of the bracket 39 onto a tubular frame portion of the rollator 22, whereby the end of the lever operates as a cam to bias the locking member and to thereby firmly secure the first and second bracket portions 39*a*, 39*b*. Optionally, the locking member may comprise or include a compressible material or spring. When engaged, the quick-release mechanism secures the first and second bracket portions 39*a*, 39*b* to one another to thereby frictionally secure the carrier to the tubular frame of the rollator 22. When disengaged, the quick-release mechanism permits attachment or removal of the stand assembly, and also permits axial positioning of the stand assembly with respect to the tubular frame portion 22 of the rollator.

Other configurations are possible. For instance, the stand assembly may be secured to any one of the legs or frame elements of the rollator. The stand may be oriented towards the front or rear of the rollator instead of towards the side of the rollator as indicated. The rollator may be provided with plural stand assemblies.

The stand assembly may be made of any suitable material, such as polypropylene.

It is therefore seen that the foregoing teachings provide a rollator with a stand assembly that includes a stand for supporting the rollator in a folded position but that folds to a stowed position during operation.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. A rollator comprising:

a supporting frame having a user gripping portion and plural rolling wheels, the frame being foldable over a range of travel between a fully open operating position and a fully closed storage position;

a stand assembly connected to an element of the frame and configured to support the rollator when said rollator is in the fully closed storage position, the stand assembly comprising:

a stand and a bracket, the stand being pivotable with respect to the bracket and movable over a range of travel between a stowed position and a support position, the stand being at an angle relative to a frame surface of said supporting frame when in said support position;

a cam surface, said cam surface being functionally integral with respect to said stand, said cam surface having a stowage region and a supporting region and an intermediate cam region;

a sprung follower, said sprung follower engaging said cam surface and engaging said stowage region when the stand is in said stowed position and engaging said supporting region when said stand is in said support position thereby indexing said stand in one of said supporting and stowed positions.

2. The rollator of claim 1, said stand comprising a base that provides lateral support on either side of said frame.

3. The rollator of claim 2, said stand comprising a generally triangular region having first and second support arms and a base surface that has a lateral extension away from said frame in either direction when said stand is in said support position.

4. The rollator of claim 1, said bracket comprising a quick-release lever for securement of said bracket onto said frame.

5. The rollator of claim 1, said bracket comprising a hinge for opening said bracket and releasing said bracket from said frame.

6. The rollator of claim 1 wherein:

said supporting frame is foldable over said range of travel between said fully open operating position and said fully closed storage position, wherein said range of travel is along an axis;

said stand and said bracket, said stand being pivotable with respect to the bracket and movable over a range of travel between said stowed position and said support position, wherein said range of travel is along an arcuate path, wherein the arcuate path is in a plane that is intersected by the axis.

7. The rollator of claim 1 wherein said bracket includes a slot adapted to accommodate brake cable.

8. A method of using a rollator comprising:

folding a supporting frame over a range of travel between a fully open operating position to a fully closed storage position;

pivoting a stand coupled to the frame with respect to a bracket coupled to the frame over a range of travel between a stowed position and a support position an angle relative to a frame surface of said supporting frame;

moving a cam across a sprung follower during said pivoting from a stowage region of said cam, through an intermediate region of said cam, and to a supporting region of said cam, wherein said sprung follower is more compressed as said cam is moved across said sprung follower through said intermediate region, thereby indexing said stand in one of said supporting and stowed positions.

9. The method of claim 8, said pivoting comprising pivoting said stand comprising a base that provides lateral support on either side of said frame.

10. The method of claim 9, said pivoting comprising pivoting said stand comprising a generally triangular region having first and second support arms and a base surface that has a lateral extension away from said frame in either direction when said stand is in said support position.

11. The method of claim 8, said pivoting comprising pivoting said stand with respect to said bracket, said bracket comprising a quick-release lever for securement of said bracket onto said frame.

12. The method of claim 8, said pivoting comprising pivoting said stand with respect to said bracket, said bracket comprising a hinge for opening said bracket and releasing said bracket from said frame.

13. The method of claim 8 wherein:

said folding said supporting frame comprising folding said supporting frame over said range of travel between said fully open operating position and said fully closed storage position, wherein said range of travel of is along an axis;

said pivoting said stand with respect to said bracket, said stand being pivotable with respect to said bracket and movable over a range of travel between said stowed position and said support position, wherein said range of travel is along an arcuate path, wherein the arcuate path is in a plane that is intersected by the axis.

14. The method of claim 8 said pivoting comprises pivoting said bracket, said bracket includes a slot adapted to accommodate brake cable.

15. A rollator comprising:

a supporting frame having a user gripping portion and plural rolling wheels, the frame being foldable over a range of travel between a fully open operating position and a fully closed storage position;

a stand assembly connected to an element of the frame and configured to support the rollator when said rollator is in the fully closed storage position, the stand assembly comprising:

a stand and a bracket, the stand being pivotable with respect to the bracket and movable over a range of travel between a stowed position and a support position, the stand being at an angle relative to a frame surface of said supporting frame when in said support position;

a cam surface, said cam surface being functionally integral with respect to said stand, said cam surface having a stowage region and a supporting region and an intermediate cam region;

a sprung follower, said sprung follower engaging said cam surface and engaging said stowage region when the stand is in said stowed position and engaging said supporting region when said stand is in said support position thereby indexing said stand in one of said supporting and stowed positions;

said bracket comprising a hinge for opening said bracket and releasing said bracket from said frame;

wherein said bracket includes a slot adapted to accommodate brake cable.

* * * * *